US005101914A

United States Patent [19]

Wenzel

[11] Patent Number: 5,101,914

[45] Date of Patent: Apr. 7, 1992

[54] ORIENTATABLE ADJUSTABLE BENT HOUSING

[76] Inventor: William R. Wenzel, 3763-74 Avenue, Edmonton, Alberta, Canada, T6B 2T7

[21] Appl. No.: 606,723

[22] Filed: Oct. 31, 1990

[51] Int. Cl.[5] ..... E21B 7/08

[52] U.S. Cl. ..... 175/74; 175/256

[58] Field of Search ..... 175/73, 74, 256, 76, 175/61

[56] References Cited

U.S. PATENT DOCUMENTS

| | | | |
|---|---|---|---|
| 4,067,404 | 1/1978 | Crase | 175/75 |
| 4,077,657 | 3/1978 | Trzeciak | 285/184 |
| 4,220,214 | 10/1980 | Benoit | 175/61 |
| 4,286,676 | 10/1981 | Nguyen | 175/74 |
| 4,303,135 | 12/1981 | Benoit | 175/73 |
| 4,745,982 | 5/1988 | Wenzel | 175/74 |
| 4,811,798 | 3/1989 | Falgout, Sr. et al. | 175/73 |
| 4,813,497 | 3/1989 | Wenzel | 175/74 |
| 4,817,740 | 4/1989 | Beimgraben | 175/74 |

*Primary Examiner*—William P. Neuder

*Attorney, Agent, or Firm*—Hoffman, Wasson & Gitler

[57] ABSTRACT

An orientatable adjustable bent housing consisting of a tubular inner housing which is telescopically received within a tubular outer housing. A sleeve is provided which has an angular offset end face. The sleeve is axially slidable along the inner housing between a coupled position wherein spline non-rotatably couple the sleeve with the inner housing and an orientatable position wherein the sleeve is disengaged from the spline permitting respective rotational positioning of the sleeve and the inner housing. In the coupled position the sleeve is further slidable between an inoperative position wherein the sleeve is spaced from the outer housing and an operative position. In the operative position the angularly offset end face of the sleeve is brought in face to face relation with an angularly offset end face of the outer housing thereby creating a bend the magnitude of which is dependent upon the relative rotational positioning of the outer housing and the inner housing. An overlapping splined engagement couples the inner housing to the outer housing when the sleeve is in the operative position. A locking nut maintains the sleeve in the operative position.

2 Claims, 2 Drawing Sheets

ORIENTATABLE ADJUSTABLE BENT HOUSING

The present invention relates to an orientatable adjustable bent housing.

BACKGROUND OF THE INVENTION

Over the last few years adjustable bent housings have become well known in the oil industry in connection with the use of downhole drilling motors. For downhole drilling a number of components are used in conjunction with the downhole drilling motor. These components are a drill bit, a bearing assembly, a drive shaft, and a housing in which the drive shaft is housed. The downhole drilling motor produces an eccentric motion. The bearing assembly absorbs the radial and thrust loading from the drill bit and drives the drill bit in a concentric motion. The drive shaft is constructed with a universal joint type of connection to convert the eccentric motion of the drilling motor into concentric motion required by the bearing assembly. The drive shaft passes through the housing which is secured at one end to the drilling motor and at the other end to the bearing assembly.

In directional drilling a bend is placed in the drill string in order to cause the borehole created by the drilling process to deviate at an angle from the vertical. It is desirable to get this "bend" as close as possible to the drill bit, this is accomplished by using a bent housing. It is, however, inconvenient to disassemble the bearing assembly, drive shaft, and drilling motor in order to replace the bent housing with a different bent housing with a bend of a different magnitude. For this reason adjustable bent housings were developed. The magnitude of the bend in an adjustable bent housing is adjustable by relative rotation of two mating components. The current state of the art is reflected in U.S. Pat. No. 4,813,497 which issued to Kenneth H. Wenzel.

As the art of directional drilling progresses, the practice has developed of using an adjustable bent sub, in combination with another bent sub positioned above the drilling motor. Using two bent subs in this manner allows the borehole to be drilled at an greater angle in less time than would be possible when using only one bent sub. A problem has arisen, however, in getting the bends in the two bent subs to align. A separate tool has been developed which addresses this problem which is referred to as an orientation sub. The use of an orientation sub adds one more component to the drilling motor assembly which is viewed as undesirable.

SUMMARY OF THE INVENTION

What is required is an orientatable adjustable bent housing which will render the use of an orientation sub redundant.

According to the present invention there is provided an orientatable adjustable bent housing which is comprised of a tubular outer housing having a first end, a second end, and an interior surface. The second end of the outer housing has an angularly offset end face. A tubular inner housing is provided having a first end, a second end and an exterior surface. The first end is telescopically received within the second end of the outer housing. A sleeve is provided having a first end, a second end, an interior surface and an exterior surface. The first end of the sleeve has an angularly offset end face. Surface engagement means are provided for non-rotatably coupling the interior surface of the sleeve with the exterior surface of the inner housing. The sleeve is axially slidable along the exterior surface of the inner housing between a coupled position wherein the sleeve is non-rotatably coupled by the surface engagement means to the inner housing and an orientatable position wherein the sleeve is disengaged from the surface engagement means thereby permitting respective rotational positioning of the sleeve and the inner housing. In the coupled position the sleeve is further slidable between an adjustable position wherein the first end of the sleeve is spaced from the second end of the outer housing and an operative position. In the operative position, the angularly offset end face at the first end of the sleeve is brought in face to face relation with the angularly offset end face at the second end of the outer housing thereby aligning the inner housing and the outer housing in a bent position the magnitude of which is dependent upon the relative rotational positioning of the outer housing and the inner housing. The bend is orientatable by sliding the sleeve to the orientatable position. A first annular member projects from the exterior surface at the first end of the inner housing. The first annular member has a concave radiused contact surface. A second annular member projects from the interior surface at the second end of the outer housing. The second annular member has a convex radiused contact surface. The convex contact surface of the second annular member engages the concave contact surface of the first annular member thereby preventing axial separation of the inner housing and the outer housing while accommodating the bend created when the sleeve is in the operative position. An overlapping splined engagement between the exterior surface at the first end of the sleeve and the interior surface at the second end of the outer housing non-rotatably couples the inner housing with the outer housing when the sleeve is in the operative position. A locking nut threadedly engages the exterior surface of the inner housing to secure the sleeve in the operative position.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1A:
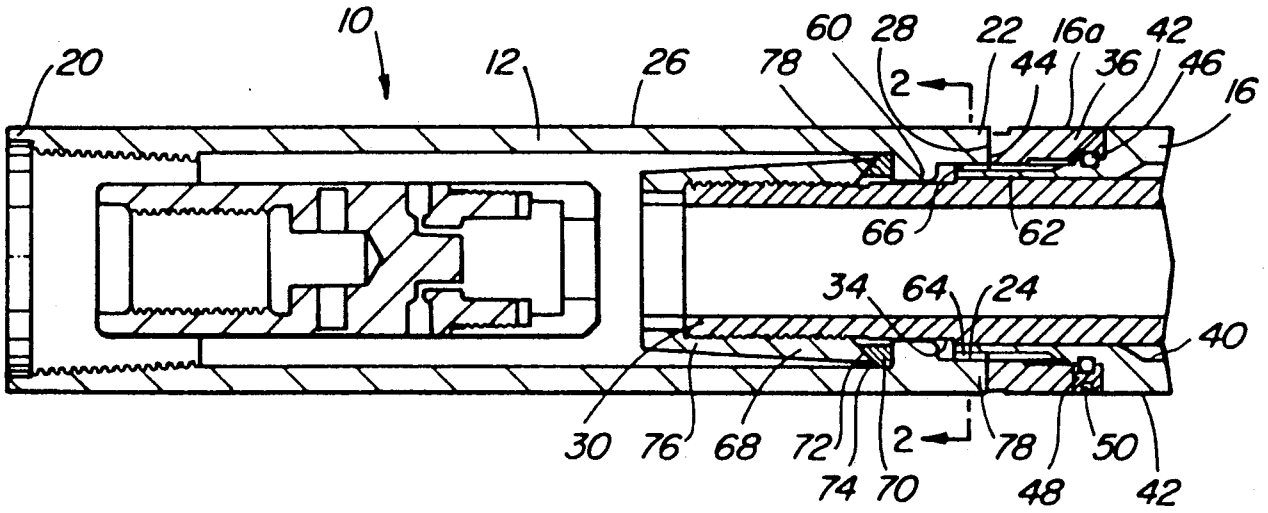
FIGS. 1*a* and 1*b* together constitute a longitudinal section view of a preferred embodiment of the invention.
Figure 1B:
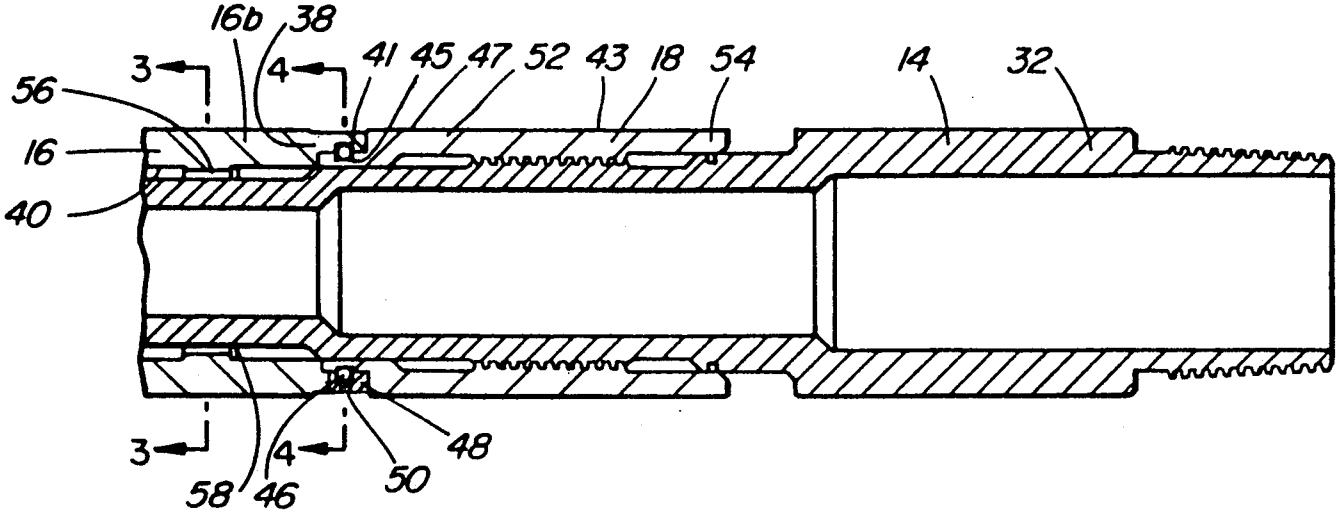

The preferred embodiment is an orientatable adjustment bent housing, generally referred to by reference numeral 10, which will now be described with reference to FIG. 1. The primary components of orientatable adjustable bent housing 10 are a tubular outer housing 12, a tubular inner housing 14, a sleeve 16, and a locking nut 18.

Tubular outer housing 12 has a first end 20, a second end 22, an interior surface 24 and an exterior surface 26. First end 20 has a threaded connection, for connection to other tubular components used with a drilling motor. Second end 22 of outer housing 12 has an angularly offset end face 28, the purpose of which will be hereinafter described.

Tubular inner housing 14 has a first end 30, a second end 32, and an exterior surface 34. First end 30 of inner housing 14 is telescopically received within second end 22 of outer housing 12. Second end 32 has a threaded connection, for connection to other tubular components used with a drilling motor.

Figure 4:
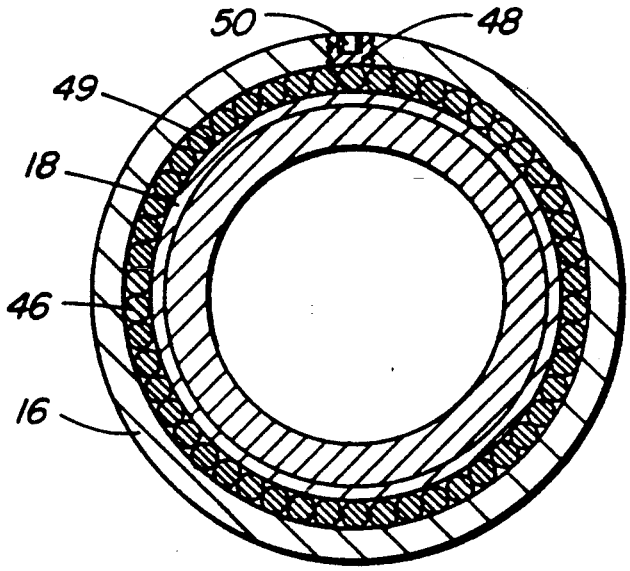
FIG. 4 is a transverse section view taken along section lines 4—4 of FIG. 1.

Sleeve 16 has a first end 36, a second end 38, an interior surface 40 and an exterior surface 42. First end 36 of sleeve 16 has an angularly offset end face 44. Sleeve 16 is longitudinally slidable on exterior surface 34 of inner housing 14 as will be hereinafter described. In the embodiment illustrated, sleeve 16 has two components 16*a* and 16*b*. These components overlap and are linked by a plurality of ball bearings 46, as illustrated in FIG. 4. Interior surface 40 of sleeve 16 has a circumferential groove 41 adjacent second end 38. Locking nut 18 has an exterior surface 43 with a circumferential groove 45 adjacent an end 47 opposite second end 38 of sleeve 16. End 47 of locking nut 18 is telescopically received by second end 38 of sleeve 16. In this telescopically engaged position circumferential groove 41 is opposite circumferential groove 45 forming a ball bearing race 49. Ball bearings 46 disposed in the ball bearing race couple sleeve 16 and locking nut 18. A passage 48 extends through sleeve 16 to permit ball bearings 46 to be inserted. Passage 48 is closed after insertion of ball bearing 46 by a plug 50.

Locking nut 18 has a first end 52 and a second end 54. Locking nut 18 is threadedly engageable with exterior surface 34 of inner housing 14 as will be hereinafter described. Second end 52 of locking nut 18 is overlapped by second end 38 of sleeve 16, and sleeve 16 is linked to locking nut 18 by a plurality of ball bearings 46. As previously described, a passage 48 extends through sleeve 16 to permit ball bearings 46 to be inserted. Passage 48 is closed after insertion of ball bearings 46 by a plug 50.

Figure 3:
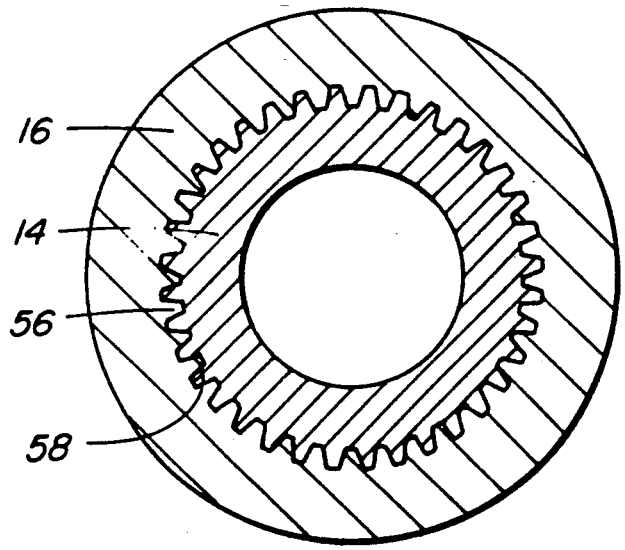
FIG. 3 is a transverse section view taken along section lines 3—3 of FIG. 1.

Referring to FIG. 3, surface engagement means in the form of mating spline 56 and 58 non-rotatably couple sleeve 16 with inner housing 14. Spline 56 depends from interior surface 40 of sleeve 16 and mating spline 58 is on exterior surface 34 of inner housing 14. When splines 56 are engaged with splines 58, sleeve 16 is non-rotatably coupled with inner housing 14.

Figure 2:
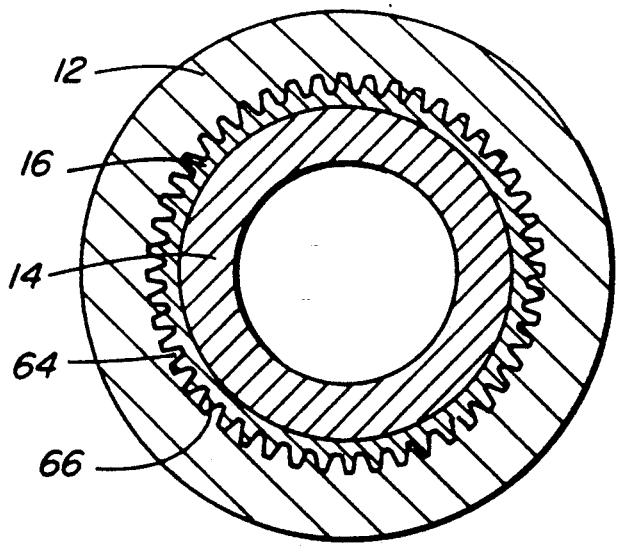
FIG. 2 is a transverse section view taken along section lines 2—2 of FIG. 1.

There is also a splined engagement between second end 22 of outer housing 12 and first end 36 of sleeve 16. Second end 22 of outer housing 12 has a protruding collar portion 60 which overlaps a protruding tapered neck portion 62 at first end 36 of sleeve 16. Referring to FIG. 2, on protruding collar portion 60 interior surface 24 of outer housing 12 has depending spline 64 which engage mating spline 66 on exterior surface 42 of protruding neck portion 62 of sleeve 16.

The axial withdrawal of inner housing 14 from outer housing 12 is prevented by annular members 68 and 70. First annular member 68 is secured to exterior surface 34 at first end 30 of inner housing 14. Second annular wedge 70 is secured to interior surface 24 at second end 22 of outer housing 12. Second annular member 70 engages first annular member 68 to prevent axial movement of inner housing 14 in relation to outer housing 12. First annular member 68 and second annular member 70 have mating radiused contact surfaces 72 and 74, respectively. Contact surface 72 is concave, while contact surface 74 is convex. First annular member 68 is part of an end cap 76 secured to first end 30 of inner housing 14. Second annular member 70 is positioned against a shoulder 78 which protrudes from interior surface 24 at second end 22 of outer housing 12.

The use and operation of orientatable adjustable bent housing will now be described with reference to FIG. 1. When orientatable adjustable bent housing 10 is placed in position between the bearing assembly (not shown) and drilling motor (not shown) a drive shaft 80 extends through orientatable adjustable bent housing 10. Sleeve 16 is axially slidable along exterior surface 34 of inner housing 14 between a coupled position and an orientatable position. In the coupled position sleeve 16 is non-rotatably coupled by the mating of spline 56 and 58 to inner housing 14. In the orientatable position spline 56 of sleeve 16 are disengaged from spline 58 of inner housing 14 permitting respective rotational positioning of sleeve 16 and inner housing 14. In the coupled position sleeve 16 is further slidable between an adjustable position and an operative position. In the adjustable position first end 36 of sleeve 16 is spaced from second end 22 of outer housing 12. In the adjustable position respective rotational adjustment can taken place between inner housing 14 and outer housing 12. In the operative position, angularly offset end face 44 at first end 36 of sleeve 16 is brought in face to face relation with angularly offset end face 28 at second end 22 of outer housing 12 thereby creating a bend the magnitude of which is dependent upon the relative rotational positioning of outer housing 12 and inner housing 14.

It will be seen from the above description of the positions of sleeve 16, that in the adjustable position sleeve 16 is non-rotatably coupled to inner housing 14 so that a respective rotation of inner housing 14 in relation to outer housing 12 will change the mating of angularly offset end faces 28 and 44. If the bent created by the mating of angularly offset end faces 28 and 44 requires orientation, this is accomplished by moving sleeve 16 to the orientatable position permitting respective rotation of sleeve 16 and inner housing 14 until the bend is orientated in the desired direction. Sleeve 16 can then be placed in the operative position with the bend at the desired angle and in the right direction. Sleeve 16 is maintained in the operative position by locking nut 18 which engages exterior surface 34 of inner housing 14. In the operative position, inner housing 14 is non-rotatably coupled via sleeve 16 with outer housing 12, to maintain the desired rotational positioning of inner housing 14 and outer housing 12. The non-rotational coupling is accomplished by a combination of mating spline 56 and 58 which non-rotationally couple sleeve 16 to inner housing 14; and mating spline 64 and 66 which non-rotationally couple sleeve 16 to outer housing 12.

It takes a special form of stop means to accommodate the altering of the respective angular positioning of the outer housing 12 and the inner housing 14. However, with the mating annular members 68 and 70, whatever bent is created when sleeve 16 is secured in the operative position can be accommodated by the radiused contact surfaces 72 and 74 which can mate regardless of the angular position assumed. Convex contact surface of second annular member engages concave contact surface of first annular member. The actual point of contact varies with the bend created. The radius of the contact surfaces 72 and 74 are preferably taken from a centerpoint positioned along the mating of angularly offset end faces 28 and 44.

In order to effect an angular adjustment of orientatable adjustable bent housing 10, locking nut 18 must be "backed off" to permit sleeve 16 to be moved axially along inner housing 14. The presence of ball bearings 46 results in locking nut 18 being linked with sleeve 16 such that as locking nut 18 is loosened first end 36 of sleeve 16 is drawn away from second end 22 of outer housing 12. Once sleeve 16 has been drawn back approximately ¾ of an inch spline 64 disengage spline 66 permitting relative rotation between outer housing 12 and inner housing 14. This relative rotation results in angularly offset end face 44 at first end 36 of sleeve 16 changing its position in relation to angular offset end face 28 at second end 22 of outer housing 12 thereby altering the magnitude to the bend in orientatable adjustable bent housing 10.

If it appears that it is necessary to "orient" the bend to correspond with a bent sub positioned above the drilling motor, this is accomplished by sliding sleeve 16 further along exterior surface 34 toward second end 32 of inner housing 14. As sleeve 16 moves toward second end 32 of inner housing 14 it reaches a position where it is no longer in the coupled position as spline 56 disengage spline 58 permitting relative rotation of sleeve 16 and inner housing 14. Sleeve 16 is then considered to be in an "orientatable" position, permitting the bend is orientated in a desired direction.

The necessary adjustment having been made, sleeve 16 is slid along inner housing 14 until it is firstly in a coupled position, and then upon further sliding of sleeve 16 is placed in an operative position. Locking nut 18 is then tightened until sleeve 16 is tightly secured in place with first end 36 engaged by second end 22 of outer housing 12 and second end 38 engaged by first end 52 of locking nut 18.

It can be seen from an examination of FIGS. 2 and 3, that the splined engagements used have 48 teeth which permit adjustment in ⅛ of a degree increments. This is a more refined adjustment than is possible with many prior art tools. Indicia is placed on the exterior of orientatable adjustable bent housing 10 to serve as a guide in making adjustments of the angle of the bend and the orientation.

It will be apparent to one skilled in the art that the mating engagement of splines 64 and 66 at the overlapping of first end 36 of sleeve 16 and second end 22 of inner housing 14 precludes the entry of drilling fluid between annularly offset end faces 28 and 44, which over time can adversely effect the operation of the tool.

It will also be apparent to one skilled in the art that the use of ball bearings 46 to couple sleeve 16 and locking nut 18 resolves a problem in the art with respect to the use of sleeves. In the prior art the sleeves used were difficult to move due to dried drilling fluids or corrosion. Often a hammer and chisel had to be used to detach sleeve 16 from inner housing 14.

It will finally be apparent to one skilled in the art that modifications can be made to the preferred embodiment without departing from the spirit and scope of the invention.

For example: the increments of adjustment of ⅛ degree can be increased or decreased by increasing or decreasing the number of spline or tooth engagement positions.

The ability to orientate the bend below the motor is not necessarily needed to align two bends, but eliminates the need to adjust the measuring tool above the motor (i.e. steering tool, MWD etc.), each time the degree of bend has been changed below the motor.

The embodiments of the invention in which an exclusive property or privilege is claimed are defined as follows:

1. An orientatable adjustable bent housing, comprising:

a. a tubular outer housing having a first end, a second end, and an interior surface, the second end of the outer housing having an angularly offset end face;

b. a tubular inner housing having a first end, a second end and an exterior surface, the first end being telescopically received within the second end of the outer housing;

c. a sleeve having a first end and a second end, an interior surface and an exterior surface, the first end of the sleeve having an angularly offset end face;

d. surface engagement means for non-rotatably coupling the interior surface of the sleeve with the exterior surface of the inner housing, the sleeve being axially slidable along the exterior surface of the inner housing between a coupled position wherein the sleeve is non-rotatably coupled by the surface engagement means to the inner housing and an orientatable position wherein the sleeve is disengaged from the surface engagement means thereby permitting respective rotational positioning of the sleeve and the inner housing, in the coupled position the sleeve being further slidable between an inoperative position wherein the first end of the sleeve is spaced from the second end of the outer housing and an operative position wherein the angularly offset end face at the first end of the sleeve is brought in face to face relation with the angularly offset end face at the second end of the outer housing thereby aligning the inner housing and the outer housing in a bent position the magnitude of which is dependent upon the relative rotational positioning of the outer housing and the inner housing, the bend being orientatable by sliding the sleeve to the orientatable position;

e. a first annular member projecting from the exterior surface at the first end of the inner housing, the first annular member having a concave radiused contact surface;

f. a second annular member projecting from the interior surface at the second end of the outer housing, the second annular member having a convex radiused contact surface, the convex contact surface of the second annular member engaging the concave contact surface of the first annular member thereby preventing axial separation of the inner housing and the outer housing while accommodating the bend created when the sleeve is in the operative position;

g. an overlapping splined engagement between the exterior surface at the first end of the sleeve and the interior surface at the second end of the outer housing thereby non-rotatably coupling the inner housing with the outer housing when the sleeve is in the operative position; and h. a locking nut threadedly engageable with the exterior surface of the inner housing, the locking nut being adapted to secure the sleeve in the operative position.

2. The orientatable adjustable bent housing of claim 1, wherein one of the locking nut or sleeve having an interior surface with a circumferential groove, the other of the locking nut or sleeve having an exterior surface with a circumferential groove, the one with the circumferential groove on the exterior surface being telescopically received in the other having the circumferential groove on the interior surface such that the circumferential grooves are placed in opposed relation thereby forming a ball bearing race, a plurality of ball bearings being disposed in the ball bearing race thereby coupling the sleeve and the locking nut.

* * * * *